United States Patent [19]

McEathron

[11] Patent Number: 4,538,773

[45] Date of Patent: Sep. 3, 1985

[54] APPARATUS FOR COLLECTING STRANDS

[75] Inventor: Eugene D. McEathron, Butler, Pa.

[73] Assignee: PPG Industries, Inc., Pittsburgh, Pa.

[21] Appl. No.: 581,626

[22] Filed: Feb. 21, 1984

[51] Int. Cl.[3] ..... B65H 54/00; B65H 54/28; B65H 57/28

[52] U.S. Cl. ..... 242/18 G; 242/42; 242/43 R; 242/157 R

[58] Field of Search ..... 242/18 G, 18 R, 42, 242/43 R, 157 R

[56] References Cited

U.S. PATENT DOCUMENTS

| | | | |
|---|---|---|---|
| 2,092,811 | 9/1937 | Moncrieff et al. | 242/42 |
| 2,345,538 | 3/1944 | Lewis | 242/42 |
| 2,345,544 | 3/1944 | Worthington | 242/42 |
| 3,365,145 | 1/1968 | Klink et al. | 242/42 X |
| 3,371,877 | 3/1968 | Klink et al. | 242/18 G |
| 4,130,248 | 12/1978 | Hendrix et al. | 242/42 X |
| 4,322,041 | 3/1982 | Schuller et al. | 242/42 |

*Primary Examiner*—Stanley N. Gilreath

*Attorney, Agent, or Firm*—John E. Curley

[57] ABSTRACT

An apparatus for producing and winding strands formed of filaments to achieve good split efficiency on removal of the plurality of strands from the package for further processing, and to produce a package of wound strands having good edges.

The apparatus has a filament forming means, gathering means to gather the filaments into a plurality of strands, rotatable winder to attenuate and wind the strands, a traverse vehicle guide, reciprocating means, and contacting means. The traverse vehicle guide has a base and angularly opposing sides that converge toward each other with one side being longer than the other. The sides do not touch each other and thereby form an opening for placement of the strands into a containment area formed by the angularly opposing sides and the base. The traverse guide deposits the strands in essentially uncrossed, side-by-side relation, and cooperates with the contacting means at each end of a layer to deposit the strands in grouped relationship.

10 Claims, 5 Drawing Figures

APPARATUS FOR COLLECTING STRANDS

BACKGROUND OF THE INVENTION

This invention relates to an apparatus for producing packages of filaments, strands and the like.

More particularly, this invention is directed to an apparatus for producing packages having a plurality of strands so that the packages have neat edges and from which the removal of the distinct strands from the package is facilitated.

In the manufacture of continuous filaments or strands, the packaging of these materials to facilitate the removal of the continuous materials for use in sundry processes is an important aspect in their manufacture. Generally, when continuous filaments or strands are produced they are wound onto a package, and the package of filaments or strands is used subsequently to produce various manufactured products. The filaments or strands must be easily movable from their packages to have an efficient operation in producing manufactured products, and this is particularly important for multistrand packages. In addition, a package of continuous filaments or strands containing a plurality of distinct filaments or distinct strands should have neat edges and not a loopy appearance at the ends of the package. A loopy end package is detrimental to removing the distinct filaments or strands for further processing, since this type of package contains groups of filaments or strands in which one filament or strand of an array is wrapped on a substantially larger or smaller diameter of the package than another filament or strand in the same array. When this type of package is unwound different lengths of the filaments or strands would be obtained. This difference in length is commonly referred to as catenaries. The catenaries can cause looping and snarling in the processing of the continuous filaments or strands from the package into manufactured products. Also this type package presents a greater risk for damage occurring to the continuous filaments and/or strands at the edge of the package. During shipment of the other packages, any damage to the continuous filaments or strands at the ends of the packages could result in broken filaments or strands engendering difficulties when the filaments are removed from the package. A loopy end package usually has a larger diameter in the center of the package than the diameter at the ends of the package. An extreme uneveness in the diameter of the package requires the controlled use of additional devices in winding such a package so that the guide used to traverse the continuous filaments or strands onto the package continuously moves away from the building package. This movement prohibits the building package from touching the traversing guide.

In the manufacture of continuous glass filaments and/or strands, a roving can be produced, which is a cylindrically shaped package of one or more bundles of glass filaments wound in parallel. Traditionally, these roving packages have been produced by mounting a plurality of packages of glass fiber strands that were produced in forming the glass fiber strand on a creel or support and gathering the plurality of strands in a parallel array and winding these strands onto a cylindrical package.

Recently it has become a standard practice in the industry to produce a cylindrically shaped package of bundles of glass fibers during the formation of the glass fibers. This directly wound package has at least flat surfaces and at least nearly square edges on both ends of the packages. Such a directly wound cylindrical package of strand has the benefit of being made on a large scale in one operation, i.e. starting with the glass making raw materials and finishing with a cylindrical package sometimes referred to as a roving package that is ready for packaging and shipment.

Reportedly, a direct drawn roving package has been developed to take full advantage of even tensioning of glass fibers that are to be used in reinforcing polymeric materials. This is reported at pages 261 through 263 in "The Manufacturing Technology of Continuous Glass Fibers", by K. L. Lowenstein, Elsevior Scientific Publishing Company, Amsterdam, The Netherlands, 1973. In the production of roving packages, the lay of the strands in the successive layers making up the package is important to achieve the desired dimensions of the package. Also, the lay of the strands is important in roving packages in removing the strands from a roving package to use the strands for various applications, such as the formation of continuous strand mat, or the chopping of the strands to produce chopped glass fibers for reinforcement of polymeric and/or elastomeric materials, and/or the production of chopped strand mats. The ability to obtain the same number of distinct strands out of the wound roving package as were placed into the wound roving package during processing is an important parameter to the efficiency of further process operations. This ability is referred to as the splitting efficiency, which is defined in the book "The Manufacturing Technology of Continuous Glass Fibers" at pages 181 and 182.

It would be beneficial to both the producer and user of glass fiber strand to produce glass fiber strands in a multistrand, roving package produced directly in drawing the glass fibers, where the direct drawn roving packages have a good shape and a good split. To this end, the art has made numerous attempts to commercially produce a multiple strand, directly drawn roving product, but currently such a product is not readily available in the marketplace.

An early attempt discussed in U.S. Pat. No. 3,365,145 involves the use of a traversing device with a sensing means along with projections from the traversing device having pins which contact the edge of the layers of strands being wound so that the edge of the layer of a plurality of strands is forced into a straight edged package.

Another approach disclosed in U.S. Pat. No. 3,371,877 (Klink et al.) involves the use of a traversing device having a guide, which is a comb, wherein in each slot of the comb a single strand is located for placement of the strands in side-by-side array in the layer on the wound package. Above the comb on either end of the traverse are studs upon which the strand impinges at the end of each traverse to provide edge control building up the successfully layered package. As is shown in the patent at FIG. 6, this edge control still allows the strands coming from the comb to remain in side-by-side relationship. Underneath the comb receiving the strands coming from the comb is a T-shaped slotted device acting as a sensor and guide member as the strands are wound in side-by-side relation onto the package.

A more recent approach is disclosed in U.S. Pat. No. 4,322,041 (Schullar et al.) which discloses the use of a traverse guide member which is used in very close proximity to the package of continuous multiple strand material being wound. The strand traverse guide is a vertical concave device with a V-shaped slot. The plurality of strands ride as separated strands on one or the other of the sloping sides of the V-shaped slot depending upon which direction the strand traversing guide is being traversed. The strand traversing guide also has a surface portion beneath the V-shaped slot, which contacts all the strands and is in intimate contact with the rotating winder upon which the package is wound. This allows the strands to be wound on to the package almost immediately after contacting this surface portion of the guide.

In a co-pending application of the applicant's assignee U.S. Ser. No. 456,886, filed Jan. 10, 1983, a method and apparatus is described which is an improvement on the aforementioned art.

It is an object of the present invention to provide an improved vehicle guide mechanism for use in producing wound cylindrical package of a plurality of distinct filaments or distinct strands, which is simple in construction, light in weight and can thread up the strands in a simple, efficient manner.

It is a further object of the present invention to provide a vehicle guide useful in traversing linear filamentary materials that can be used in various winding and traversing apparatus to produce a package of wound continuous filament strands having a reduced risk of damage to any of the strands in the package and having a good split efficiency with the distinct strands in side-by-side spaced relation to each other for the majority of the length of the successive layers in the package but having a side-by-side touching relationship at the ends of the package.

SUMMARY OF THE INVENTION

In accordance with the instant invention a plurality of filaments or a plurality of bundles of filaments hereinafter strands, can be produced and collected by an apparatus having: a means for forming a plurality of the continuous filaments from a supply; a means for gathering the plurality of filaments into strands; a rotatable winder to collect the more than one strand; a traversing vehicle guide to engage the strands and to guide them onto the rotating winder to produce successive layers of strands; a reciprocating means mounted to the traversing guide so that the traversing guide is approximately horizontally positioned to reciprocate the traversing guide with the strands to form the layers of strands on the rotating winder, and contacting means mounted so that the strands contact the means at a location aligned at or near each end portion of the layers on the rotating winder in a manner such that the strands remain in the vehicle guide during traverse.

The means for forming the plurality of continuous filaments can be any means used for forming filaments; for example, in forming glass filaments the means can produce streams of glass flowing from a supply of heat softened fiberizable glass batch material and apply a chemical material to the surface of the filaments. The means for gathering the filaments into the strands can be any means to bring more than one filament together to form a strand and such means is usually located a sufficient distance from the means for forming the filaments to allow the filaments to cool to a temperature at which they can have the chemical material applied to them before they are gathered. The rotating winder collects the strands and attenuates the continuous filaments from the supply of heat softened material and supports a successively layered cylindrical package of the strands. For example, in forming glass filaments the rotatable winder attenuates the continuous glass filaments from the supply of heat softened, fiberizable, glass batch material that issues the streams of flowing glass.

The traversing vehicle guide of the instant invention is generally triangular in shape. The guide has a base and two sides each of which converges toward the other side, with one side being slightly longer than the other i.e. $\frac{1}{8}$ to $\frac{3}{8}$ inches longer. The converging sides do not meet and thus form an open ended, triangular containment zone for strands. The corners at the base of the containment zone can be sharp or rounded, the preferred embodiment being rounded. The angle formed by each of the sides with the base is between 35° and 85°; preferably 65° to 75°. The elongated side of the containment zone acts to guide strands into the containment zone and to maintain the strands in the containment zone.

The reciprocating means traverses the vehicle guide linearly along the axis of rotation of the rotatable winder to distribute the strands in successive layers on the rotating winder to form the essentially cylindrical package of successive layers of strands. The traversing vehicle guide is mountable on the reciprocating means in an approximately horizontal position, where the degree of variation from the horizontal position can be up to around 45° in an upward or a downward direction. The approximately horizontally positioned traversing guide, when reciprocated, places the strands onto the rotating winder in substantially side-by-side relation to each other for a majority of the linear length of each layer parallel to the axis of rotation of the winder and with coaction from the contacting means in grouped relation at both end portions of each layer. Successive layers of this pattern are built up to produce an essentially cylindrical package.

Contacting means are positioned so as to contact the strands nearly adjacent to the ends of the layers formed on the winder so that the strands touch the contacting means as the vehicle guide moves past the contacting means. The strands are gathered into a group at the proximate corner of the traverse guide in relation to the center of the layer. This grouping of the plurality of strands is guided by the traversing vehicle guide in concert with the contacting means onto the end portion of the layer on the winder.

BRIEF DESCRIPTION OF THE DRAWINGS

The apparatus of the present invention will be more fully described in respect to the attached drawings in which.

DETAILED DESCRIPTION OF THE DRAWINGS

While the apparatus, of the present invention is particularly suitable for forming filaments of heat-softened, fiberizable material such as glass for producing glass filaments and producing multistrand roving of the glass filaments, in the broadest aspect of the present invention, the apparatus may be utilized for producing packages, and particularly roving packages, of filamentary materials other than glass. The following disclosure will be directed to the formation and winding of a plurality of glass strands having continuous glass fiber filaments, although such disclosure is not limited to the type of filaments that can be formed and wound by the apparatus of the present invention using the method of the present invention to produce the package of the present invention as aforementioned.

Figure 2:
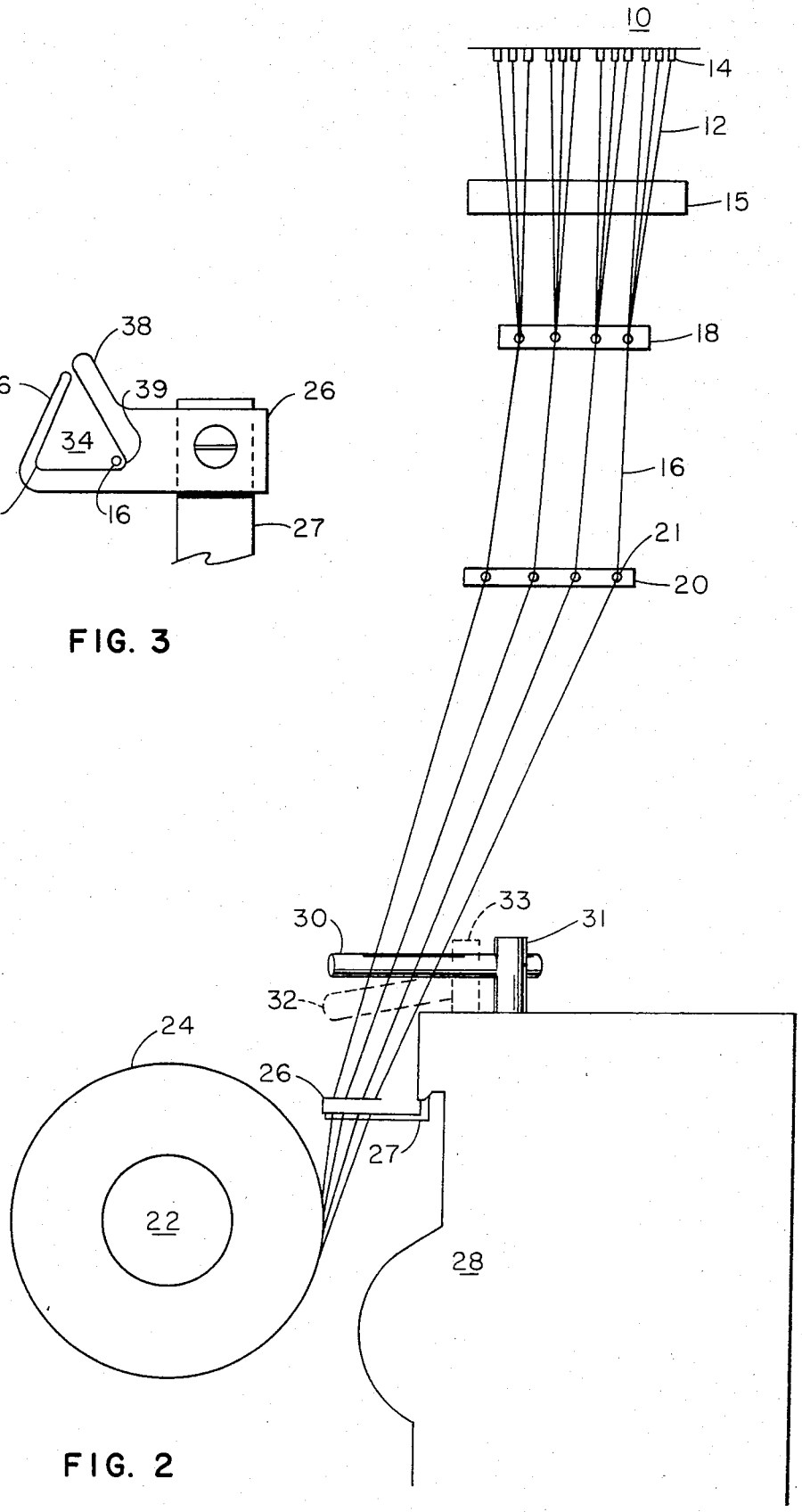
FIG. 2 is a view taken in front elevation of apparatus for forming continuous filaments and winding a plurality of bundles of continuous filaments into an essentially cylindrical package using the traversing guide of the invention.
Figure 4:
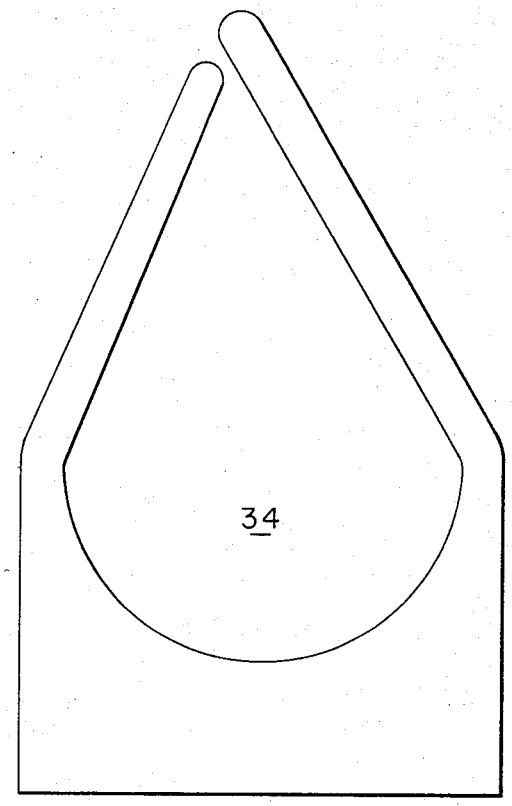
FIG. 4 is a plan view of the vehicle guide having a semi-circular containment zone.
Figure 5:
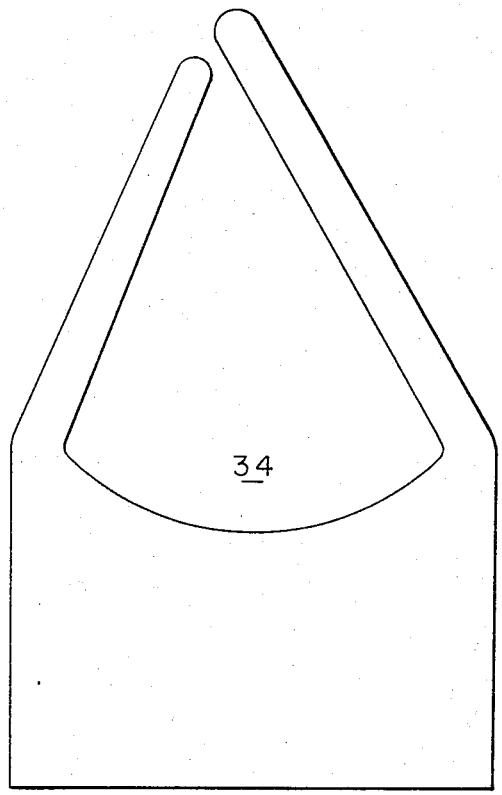
FIG. 5 is a plan view of a vehicle guide having a semi-eliptical containment zone.

Referring to FIG. 2, there is illustrated a fiber forming apparatus generally designated as 10 from which glass filaments 12 are drawn or attenuated from cones of heat softened glass suspended from tips 14 in the openings of the bottom of the bushing 10. The bushing 10 may, for example, have 40 pairs of rows with 25 tips in each pair of rows so that about 2,000 fibers can be simultaneously drawn from the tips in the bushing 10. From each of the pairs of rows around 50 to 1,000 fibers are gathered and formed into more than one strand, each designated 16. These strands 16 are formed by gathering the filaments 12 in gathering shoe 18. The gathering shoe can be any device known to those skilled in the art for gathering filaments into strands, a nonexclusive example of which is a rotatable gathering shoe, which is usually made of graphite. Another nonexclusive example is a stationary shoe or comb, which can be made of graphite or cotton and phenolic resin laminate, such as micarta or reinforced phenolic laminates. Before the filaments 12 are gathered into one or more strands 16, the filaments are passed in contact with an applicating device, 15, to supply the fibers with a coating of chemical material over a substantial portion of their surfaces. The coating usually has a carrier such as water or an organic liquid and may have one or more coupling agents and/or binder solutions having one or more film forming polymers and/or one or more lubricants, surfactants, emulsifiers and the like.

Figure 1:
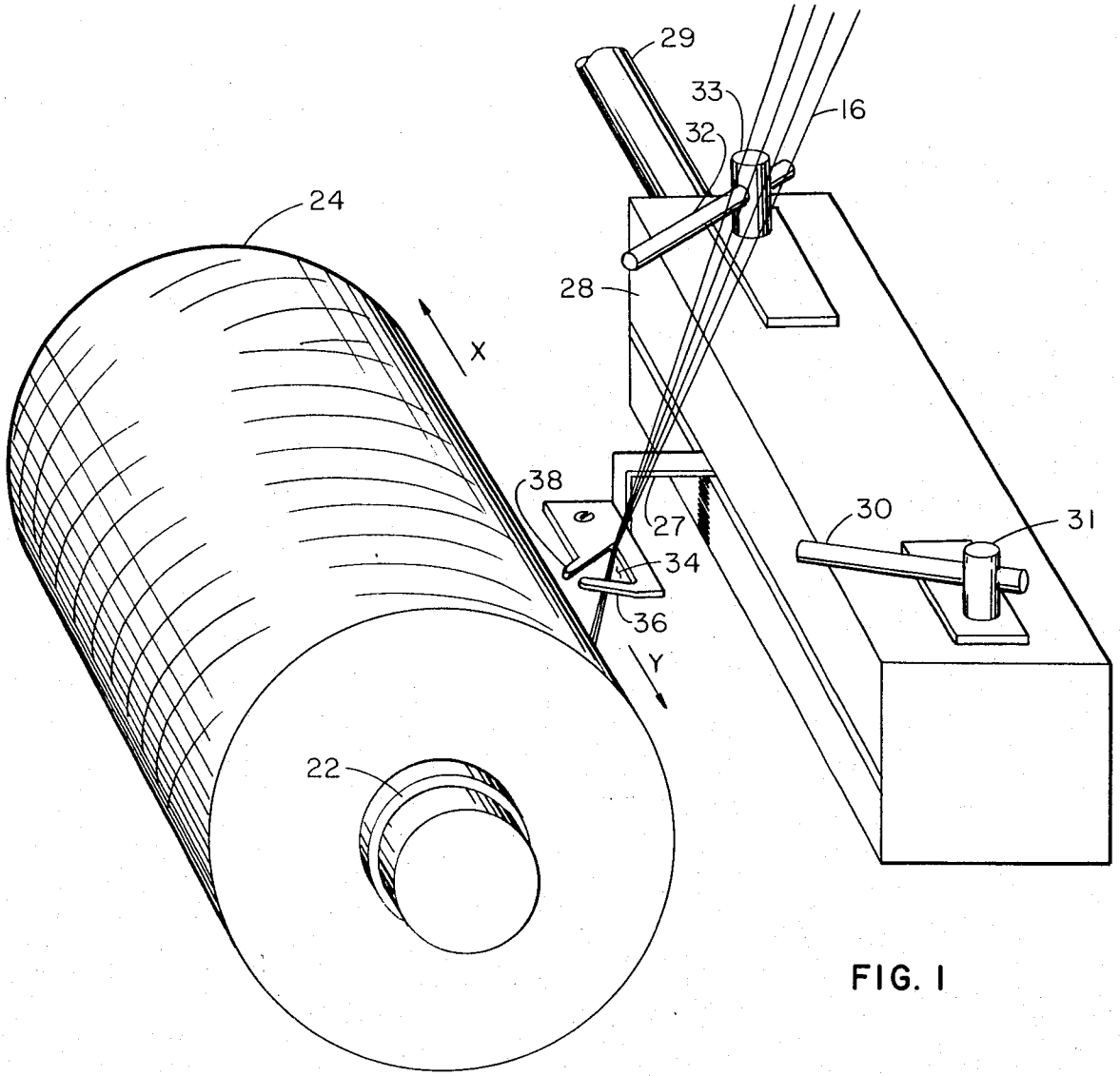
FIG. 1 is an enlarged isometric view of a winder, reciprocating means and the traversing vehicle guide of the instant invention.

Although FIGS. 1 and 2 indicate that four strands, can be formed from the illustrated number of filament 12, the present invention is not restricted to operation with four strands, but is particularly useful for simultaneous winding of greater numbers of strands, for example, twelve strands or even more. The number of strands generally varies from two to more than twelve.

The strands, 16, from the gathering or splitting device 18 travel downwardly. In a double level operation, the strands travel along divergent paths established by bar 20, which has a plurality of guides 21 to accommodate the number of strands so as to direct the strands further downward to converge at the winder after passing through the traversing device 26 for disposition onto a rotating winder, mandrel or collet 22. Bar 20 is needed in a double level operation because the glass filament 12 travel a distance from the bushing to the point of being wound onto a package, which is the distance of two operating floors (not shown). In the double level operation, the distance between the bushing nozzles and the axis of the winder is generally around 3.5 to 4 meters. The bar 20 separates the strands from each other a sufficient distance so that when the strands pass through the traversing device the converging paths of the strands still allow for some separation at the traversing device. In a single level operation, where the distance between the nozzles 14 of the bushing 10 and the axis of the winder 22 is around 2 to about 2.5 meters, the bar 20 is not necessary because the converging paths of travel of the strands 16 usually naturally allows for such a separation of the strands at the traversing device. In the double level operation, if the strands are not adequately separated from each other at the traversing guide 26, the holes or guides 21 in bar 20 are separated further from each other to cause the strands to diverge to a greater extent. This further divergence of strands increases the length of the point of convergence downwardly away from bar 20, and permits an increase in the separation of the strands at the traversing guide 26. If less separation of the strands at the traversing guide 26 is desired, the holes or guides 21 that contain the strands are moved closer to each other. Generally, the strands on either end of bar 20 can be moved outwardly from the center of the bar to a distance, where the angle formed in the strand between the ingressing strand segment and the egressing strand segment to bar 20 can be up to around 45°.

As the strands 16 travel downwardly in converging paths to winder 22, which provides the force of attenuation for the filaments 12 from bushing 10 and which also winds the strands 16 into a package 24, the strands 16 are guided in traversing manner by the traversing vehicle guide 26. The winder may be any conventional winder known to those skilled in the art. The winder is rotated generally by a winder motion (not shown) in a clockwise direction. The traversing vehicle guide 26 is movably attached to reciprocating means 28, which may be any recirculating means with a conventional drive means and means for converting rotational motion to linear reciprocating motion known to those skilled in the art, for example, like that disclosed in U.S. Pat. No. 3,998,404 (Reese) hereby incorporated by reference. The operation of the reciprocating means 28 causes the traversing vehicle guide 26 to move the converging strands back and forth in a direction parallel to the axis of rotation of the winder so that the strands are deposited on the winder to form a layer across the peripheral surface of the winder. As the traversing guide comes to the end of each stroke and the reciprocating means reverses, the strands hit contact means 30 on one side and contact means 32 on the other side.

The winder and reciprocating means generally interact so that one or both move away from each other as the layers of strands build up on the winder. This movement precludes any substantial contact between the traversing guide 26 and the outer layer of package 24. Any conventional mechanism known to those skilled in the art for effecting this movement can be used. For example, the mechanism in the reciprocating device of U.S. Pat. No. 3,998,404, hereby incorporated by reference, may be used or a movable winder and reciprocating means used in conjunction with an air sensing device like that of U.S. Pat. No. 4,244,533, hereby incorporated by reference, may be utilized. Also a spring sensing mechanism associated with the traversing guide and reciprocating means as known by those skilled in the art may be used to move the traversing guide and the reciprocating means away from the rotating winder.

Turning now to FIG. 1, there is shown an isometric side view of winder 22, package 24, traversing vehicle guide 26, reciprocating means 28 and contacting means 30 and 32. The reciprocating means 28 holds the traversing guide 26 in a near horizontal position and nearly perpendicular to a line centrally located between the number of strands 16 being wound. This helps minimize the amount of surface contact area the strands see when being reciprocated across the package. The plurality of strands 16 generally approach the traversing guide from a direction varying from an acute angle up to a perpendicular angle in relation to the guide. Generally, the geometry of the downwardly traveling filaments and strands 16 in relation to the winder can be any geometry known to those skilled in the art. The filament forming apparatus, gathering means, traversing guide, reciprocating means, and winder along with any applicating means and diverter means are all positioned and supported in relation to each other to obtain the proper filament and strand geometry. For example, the winder can be directly under the bushing or not directly under the bushing, but off to one side including in front of or behind the downward projections of the perimeter of the bushing.

As shown in FIG. 1, the traversing vehicle guide 26 in a near horizontal position to the reciprocating means 28 is reciprocated parallel to the axis of rotation of winder 22. The reciprocating means 28 is stationary so that the winder 22 is adapted for movement away from the reciprocating means 28, as the package 24 is built up on winder 22.

On top of reciprocating means 28 are located attachment means 31 and 33 that support contacting means 30 and 32 respectively. These contacting means can be positioned anywhere on the reciprocating means or on a separate support means so the contacting means are above or below the reciprocating traversing vehicle guide 26 and the guide can pass partially under or over the contacting means. Preferably, the contacting means 30 and 32 are located above the reciprocating traversing vehicle guide 26. Also the contacting means 30 and 32 are located so that one is adjacent each end region of package 24. The contacting means 30 and 32 need not be directly adjacent the end regions of package 24, but they should not be located beyond the position that is adjacent the end regions. The contacting means 30 and 32 can be located at a position somewhat short of the end regions of the package 24. Indeed the contacting means 30 and 32 should be movable so that, if desired, they can intentionally be located short of the end regions of the package 24. The location of the contacting means somewhat short of the position directly adjacent the ends of package 24 will be dictated by the type of strands being wound onto the winder. Generally, when the strands are tacky, the contacting means 30 and 32 should be at a position adjacent the edges or end regions of package 24 or slightly beyond the edges. Less tacky or nontacky strands will require the contacting means to be at a position adjacent a position on the package that is not so close to the edges of the package. Since vehicle guide 26 is open the contacting means 30 and 32 are inclined inwardly toward each other to maintain the strands inside of the vehicle guide 26 during reciprocation.

The contacting means 30 and 32 may be constructed of any suitable material. Particularly useful materials are glass fiber reinforced resins and unreinforced resins such as polypropylene, nylon, polyester resins, epoxy resins, polycarbonate resins and the like. Also materials may be used such as hard rubber, micarta, steel, brass and graphite. The shape of the contacting means is generally a rod but any other shape may be used as long as it does not cause any abrasion to the strands.

The position of the traversing vehicle guide 26 can be some distance from winder 22, but is always slightly elevated from the point of contact between the strands and the winder. The traversing vehicle guide is in a nearly horizontal position that can vary about 45 degrees above the horizontal line to 45 degrees below the horizontal line. The distance the guide 26 is away from the winder and the surface of the package being built during winding is that distance which will not result in the guide excessively rubbing the peripheral layer of the completed package, preferably about 2 to 20 mm.

Figure 3:
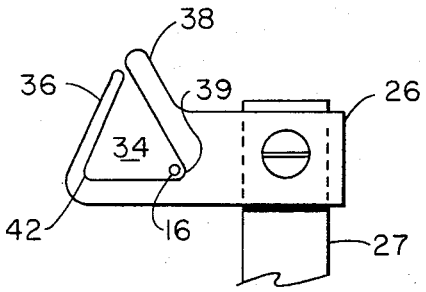
FIG. 3 is a plan view of the vehicle guide of the instant invention.

As shown in FIG. 3, the traversing vehicle guide 26 has a preferred triangular-shaped containment zone 34 formed by two angularly opposing sides 36 and 38. Side 38 is longer than side 36 in the horizontal plane so that strand riding over 36 is caught by side 38 and enters the containment zone 34 in that manner as winding of the strands begins and the guide 26 begins to reciprocate. The containment zone 34 could be shaped as a semicircle or semi-elipse or any similarly truncated circles or elipses.

The traversing vehicle guide 26, in a near horizontal position from or with tongue 27, to which it is attached, traverses along the linear length of the winder parallel to the axis of rotation of the winder. In the center portion of each traverse stroke, the strands 16 are within the containment zone 34 of traversing guide 26 so that the strands are in spaced apart arrangement on an opposing side of guide 26. The opposing side on which the strands 16 are in spaced apart relation in the nonleading opposing side farthest away from the direction of travel of the traversing guide 26 in its traversing stroke. A traversing stroke is one pass along the linear length of the winder parallel to the axis of rotation. The spaced apart strands can be positioned along the nonleading opposing side 38 from corner 39 to opening in containment zone 34 or anywhere in between when, as shown in FIG. 3 the traversing guide 26 travels in the "y" direction shown in FIG. 1. In this mode, the strands are disposed onto the winder in essentially noncrossing, side-by-side relation to each other. As the traversing guide 26 approaches the end of its traversing stroke, guide 26 partially passes under a contact means 30 as shown. As the guide 26 passes by the contact means 30, the contact means 30 contacts the strands and moves all of them by this contact to corner 39. In this mode, the gathered strands are disposed onto the winder as a group of strands. At or around this point, the reciprocating means 28 reverses the direction of tongue 27 and traversing guide 26 to move in the "x" direction. After leaving the surface of the contact means in the "x" direction, the strands are no longer being contacted by the contact means and move into spaced apart relation along the nonleading opposing side 36 of the guide 26. Once again, the disposition of the strands onto the winder is in essentially noncrossing, side-by-side relation. This pattern of disposition continues until the traversing guide 26 approaches the opposite end of the winder, where the strands 16 are contacted by means 32 and move into the corner 42 of the guide 26.

Once again in this mode, the gathered strands are disposed on the winder as a group of strands. At or around this point where the strands are gathered into corner 42, the reciprocating means 28 reverses the direction of travel of tongue 27 and traversing guide 26 to the opposite direction. As the guide 26 passes by contact means 32, the strands become positioned in noncrossing, side-by-side, spaced apart relation along the nonleading opposing side 38.

From one point of reversal to the other by the reciprocating means 28, the strands disposed on the winder constitute a layer. As the traversing guide makes a plurality of strokes from reversal to reversal, layer upon layer of strands build up on the winder 22. Since the strands 16 are consistently contacting the contacting means 30 and 32, where these contacting means are in the same location, the layers of strands built up on the winder have straight, nearly square edges. These edges result from the grouping of strands being deposited at both ends of each layer on the winder.

The reciprocating means 28 has some deceleration before reversal and some acceleration after reversal. These effects occur to some degree, while the strands are contacting one or the other of the contacting means and while the winder is rotating. The result is that the group of strands is not only disposed in a layer at the exact end of the layer, but to a degree before the end of the layer and after the end of the layer in the reverse direction. A nonexclusive example of the length of grouped strands disposed in a layer around each end is around 4 to around 8 inches (100 mm to 205 mm) of grouped strands approaching and leaving each end.

In using the vehicle guide of the instant invention, plurality of continuous filaments are supplied from the heat softened, fiberizable, glass batch material through small orifices in a bushing as known by those skilled in the art. The plurality of continuous filaments are attenuated from the bushing by the rotating winder that also collects the strands into a package. In order to collect the filaments as strands, the filaments are gathered through the aforedescribed gathering devices into more than one strand. In collecting the plurality of strands, the strands are guided onto the rotating winder by the reciprocating traversing vehicle guide to build up the layers of the plurality of strands into a package. Each of the layers have a majority of their linear length composed of the plurality of strands in essentially uncrossed, side-by-side relation to each other, while the end regions of each layer have the strand in grouped relation.

By winding the plurality of strands with the use of traverse guide 26 with the containment zone 34 reciprocatingly depositing the plurality of strands onto the package, a package having successive layers is produced which has a slightly reduced diameter in the center of the package in relation to the ends of the package.

In the prefered embodiment of the present invention the plurality of filaments are glass filament drawn from orifices in a bushing containing heat softened, fiberizable, glass material. The glass filaments are produced in a double level operation. The filaments are treated with an aqueous chemical sizing composition having one or more coupling agents, one or more lubricants and/or one or more film forming polymers in an aqueous carrier. The filaments are gathered into about 2 to about 16 or more strands and guided onto the rotating, attenuating winder by the reciprocating traversing vehicle guide 26. The traversing vehicle guide has a triangular-shaped containment zone with a small opening at the apex of the triangular zone with one side extending beyond the opening for placement of the strands into the guide. The traversing guide is reciprocating so that at the end of each stroke it partially passes under a contacting stud. Each contacting stud is situated obliquely on top of the stationary section of the reciprocating means to extend inward toward the other stud and the winder to thereby contact the strands passing to the traversing guide at the end of each stroke. When the traversing guide passes under or over each contacting stud, the contacting stud contacts the separately aligned strands that were being guided onto the winder by the nonleading side of the triangular-shaped containment area of the guide. The separate strands, which were being deposited on the winder in uncrossed, side-by-side relation to each other, are moved to the corner at the base of the triangular-shaped containment zone adjacent the nonleading side from which the separate strands were being guided. Through the cooperation of the strands contact with the contacting stud and the location at the corner of the guide, the strands are grouped into a single bundle. The grouped strands are deposited onto the winder by the guide as a group of strands. The point where the traversing guide partially passes under or over the contacting studs so that the strands are grouped into the corner of the guide by contacting the stud is the point of reversal in direction of traverse for the guide. Also, this point is roughly in line, viewing the longitudinal length of the winder, with the location on the winder, where the ends of the layers are to be located to produce a square edged package of layers of strands.

As the number of layers built up on the winder, the winder moves away from the reciprocating traverse guide to allow the formation of a package without any collisions of the traverse guide with the outer layers of the package. Afterward the package is removed from the winder and dried.

I claim:

1. An apparatus for producing and collecting a plurality of strands:

(a) a means for forming a plurality of continuous filaments from a supply, (b) means for gathering the plurality of filaments into more than one strand, (c) rotatable winder to attenuate and collect the continuous filaments in a successively layered package, (d) a traverse guide horizontally positioned to engage the strands along one or the other of two angularly opposing sides attached to a base to guide the strands into essentially uncross, side-by-side relation onto the rotating winder, the traverse guide having two angularly opposing sides inclined toward each other one of said sides being longer in a horizontal plane than the other, both sides defining an opening at their free ends and defining a containment zone with said base, said opening being of a size sufficient to permit strands to enter the containment area, (e) means for reciprocating the traverse guide to traverse the strands parallel to the axis of rotation of the winder to distribute the strands in successive layers on the rotating winder, and (f) contacting means positioned nearly in line with each end of the package, means to move the traverse guide partially past said contacting means so that strands contact said contacting means and are gathered into a group of strands on the base at the convergence of one side thereof so that the traverse guide directs the strands onto the winder around the end portion of the layers of the package.

2. Apparatus of claim 1, including an applicator means to treat glass filaments with a chemical treating composition before the filaments are gathered into more than one strand.

3. Apparatus of claim 1 which includes a diverter bar after the means for gathering the filaments and before the winder and traversing guide to cause the strands to separate a sufficient distance from each other so the strands are separate at the traverse guide.

4. Apparatus of claim 1, wherein the containment zone of the traversing device is triangular-shaped.

5. Apparatus of claim 4, wherein the triangular-shaped containment zone has an angle formed by the convergence of the two angularly opposing sides ranging from greater than 0° to less than 180° and the corners formed by the base and the angularly opposing sides have angles in the range of greater than 0° to less than 135°.

6. Apparatus of claim 1, wherein the contacting means are positioned in line with the end of the layers.

7. Apparatus of claim 1, wherein the containment zone has a semicircular shape.

8. Apparatus of claim 1, wherein the containment zone has a semieliptical shape.

9. Apparatus of claim 1, wherein the converging angularly opposing sides form an angle with the base from around 35° to around 85°.

10. Apparatus of claim 1, wherein corners formed by the base and the angularly opposing sides have angles varying from around 65° to around 75°.

* * * * *